US006729564B2

(12) United States Patent
Srinath et al.

(10) Patent No.: US 6,729,564 B2
(45) Date of Patent: May 4, 2004

(54) FLUIDIC SPA NOZZLES WITH DUAL OPERATING MODES AND METHODS

(75) Inventors: Dharapuram N. Srinath, Ellicott City, MD (US); Ronald D. Stouffer, Silver Spring, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 334 days.

(21) Appl. No.: 09/909,132

(22) Filed: Jul. 20, 2001

(65) Prior Publication Data

US 2002/0040942 A1 Apr. 11, 2002

Related U.S. Application Data

(60) Provisional application No. 60/219,644, filed on Jul. 21, 2000, and provisional application No. 60/224,015, filed on Aug. 10, 2000.

(51) Int. Cl.[7] ..... B05B 1/08

(52) U.S. Cl. ..... 239/589.1; 239/592; 239/593

(58) Field of Search ..... 239/587.5, 589, 239/589.1, 592, 593; D23/213

(56) References Cited

U.S. PATENT DOCUMENTS

| | | | | | |
|---|---|---|---|---|---|
| 3,302,640 | A | * | 2/1967 | Jacuzzi | 601/157 |
| 3,776,460 | A | * | 12/1973 | Fichter | 239/101 |
| 3,874,374 | A | * | 4/1975 | Jacuzzi | 601/169 |
| 3,985,303 | A | * | 10/1976 | Steimle | 239/428.5 |
| 4,168,705 | A | * | 9/1979 | Raab | 601/169 |
| 4,221,336 | A | * | 9/1980 | Diamond | 239/428.5 |
| 4,227,550 | A | | 10/1980 | Bauer et al. | 137/835 |
| 4,456,174 | A | * | 6/1984 | Neenan | 239/8 |
| 4,508,665 | A | * | 4/1985 | Spinnett | 261/93 |
| RE33,158 | E | | 2/1990 | Stouffer et al. | 239/589.1 |
| 5,495,627 | A | * | 3/1996 | Leaverton et al. | 4/541.6 |
| 5,657,496 | A | * | 8/1997 | Corb et al. | 4/541.6 |
| 5,920,925 | A | * | 7/1999 | Dongo | 4/541.6 |
| 6,178,570 | B1 | * | 1/2001 | Denst et al. | 4/541.6 |
| 6,186,409 | B1 | * | 2/2001 | Srinath et al. | 239/1 |
| D450,804 | S | * | 11/2001 | Srinath et al. | D23/213 |

FOREIGN PATENT DOCUMENTS

| | | |
|---|---|---|
| EP | 0106768 | 4/1984 |

* cited by examiner

*Primary Examiner*—Gene Mancene
*Assistant Examiner*—Thach H Bui
(74) *Attorney, Agent, or Firm*—Jim Zegeer

(57) ABSTRACT

Spa nozzles having dual fluidic nozzles capable of submerged operation and of selectively providing straight, concentrated, non-oscillating jets with air entrainment or an oscillating jet or slugs of water in water to provide a soothing massaging effect with no moving parts.

13 Claims, 9 Drawing Sheets

FLUIDIC SPA NOZZLES WITH DUAL OPERATING MODES AND METHODS

REFERENCE TO RELATED APPLICATIONS

The present invention is the subject of provisional application Ser. No. 60/219,644 filed Jul. 21, 2000 entitled SPA NOZZLES WITH DUAL OPERATING MODES and is also the subject of provisional application Ser. No. 60/224,015 filed Aug. 10, 2000 entitled SPA NOZZLE WITH DUAL OPERATING MODES.

BACKGROUND AND BRIEF DESCRIPTION OF THE INVENTION

This invention relates to spa nozzles having dual operating modes, and, more particularly, this invention is directed to fluidic nozzles capable of submerged operation and of providing straight, concentrated, non-oscillating jets with air entrainment or an oscillating jet or slugs of water in water to provide a massaging effect.

It is common practice in spa nozzles to provide an air line to a water supply nozzle for aeration of exhausting water. Air is typically drawn by the water through the venturi effect of the flowing water. Sometimes air is supplied under pressure from an air pump. See U.S. Pat. Nos. 5,495,627, 5,457,825, 5,444,879 and 5,238,585.

The object of the present invention is to provide an improved spa nozzle, and, more particularly, a spa nozzle having multiple operating modes, and still more particularly spa nozzles with fluidic oscillators which in one mode can oscillate or sweep the water jet back and forth in a massage action and in a second mode an air entrainment mode which provides a forceful flow of air/water mixture to provide a soothing feeling to the user.

Specifically, one embodiment, when the mode selector valve is set on "air", provides a submerged, high-velocity jet of water with air entrainment which produces a forceful flow of air and water mixture to provide a soothing feeling to the user. The flow rate of water and the quantity of air entrainment can be adjusted to suit the user's preferences. And in still another mode of operation, the mode selector valve is set on "water massage" which issues an oscillating jet of water to provide a massaging effect to the user. The intensity of the massaging effect can be adjusted by the user by controlling the water flow rate. The oscillating frequency varies directly with the flow rate through the device. Independent control can be provided in the water mode for water to be entrained in or added to an inertance tube or loop. This will allow the user to change the frequency of oscillation or sweep rate at a given flow setting. Yet another means of frequency adjustment can be provided by changing the length or inertance of the inertance loop.

In another embodiment, a splitter provides alternating pulses or slugs of water submerged under the water level in the spa tub. This embodiment has all adjustment features and capabilities described earlier.

One method to decouple the operation of the device from air ingestion into a control port is to entrain the air downstream of the control port as disclosed in Thurber et al application Ser. No. 09/899,547, filed Jul. 6, 2001 and entitled SPA NOZZLES WITH AIR ENTRAINMENT. This method allows the oscillation to occur with and without air. This method could be combined with the control port entrainment method to increase the total air ingestion and entrainment.

Two forms of fluidic oscillators are disclosed, one having a crossover-type interaction region and the other having a non-crossover-type interaction region. The non-crossover-type version offers space saving where needed. Both embodiments can have dwell at the ends of their sweep and thus are "heavy ended". All the embodiments described herein allow the frequency and consequently the wavelength to be optimized for the spa jet massaging function. It is important for the submerged water jet to have adequate momentum to cause good massaging sensation. For some purposes, it is also necessary for the slugs of water to be appropriately separated in time so that the tissues in the impact area of the human body can restore to the natural position before the arrival of the next pulse or slug of water. A frequency range of about 12 Hz to 1 Hz has been found to be useful and a preferred range of about 10 Hz to about 2 Hz.

The fluidic devices described herein, as well as other types, allow for the design of the proper frequency wavelength characteristic to provide optimum massage effects.

Thus, the invention provides: a spa nozzle for maximizing the momentum delivered by water in underwater spa massaging applications comprising:

- a no-moving-parts fluidic oscillator having an oscillation range of operation for oscillating a jet of water from about 12 Hz to about 1 Hz at full-flow settings,
- said fluidic oscillator projecting an alternating pair of slugs of water into said spa to impinge on a human body immersed in said spa at a rate from about 12 Hz to about 1 Hz determined by the rate of flow of fluid through said fluidic oscillator.

Further, the invention provides: a spa nozzle for maximizing the momentum delivered by water in underwater spa massaging applications comprising:

- a no-moving-parts fluidic oscillator having an oscillation range of operation for oscillating a jet of water from about 12 Hz to about 1 Hz at full-flow settings,
- said fluidic oscillator being heavy-ended and projecting an alternating jet of water into said spa to impinge on a human body immersed in said spa at a rate from about 12 Hz to about 1 Hz determined by the rate of flow of fluid through said fluidic oscillator.

The invention also provides: a method for maximizing the momentum delivered by water jets for underwater spa massaging applications with no moving parts comprising:

- providing a fluidic oscillator having an oscillation range of operation from about 12 Hz to about 1 Hz at full-flow settings,
- feeding only water to said fluidic oscillator to cause said fluidic oscillator to initiate oscillation and project a sweeping jet of water into said spa at sweep rate from about 12 Hz to about 1 Hz determined by the rate of flow of fluid through said fluidic oscillator.

The invention also provides: a method for maximizing the momentum delivered by water jets for spa underwater massaging applications with no moving parts comprising:

- providing a fluidic oscillator having an oscillation range of operation from about 12 Hz to about 1 Hz at full-flow settings,
- feeding only water to said fluidic oscillator to cause said fluidic oscillator to initiate oscillation and project an alternating pair of slugs of water into said spa to impinge on a human body immersed in said spa at a rate from about 12 Hz to about 1 Hz determined by the rate of flow of fluid through said fluidic oscillator.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 2:
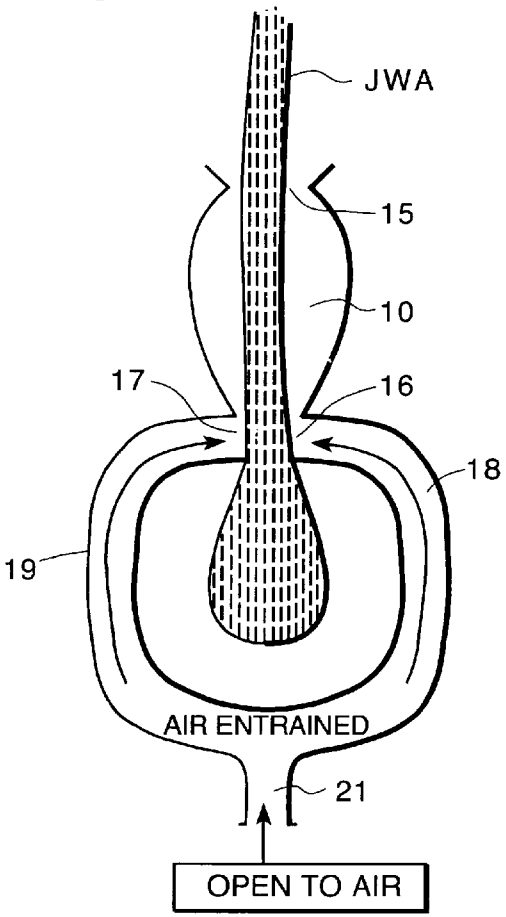
FIG. 2 is a similar schematic diagram illustrating a straight, aerated, non-oscillating jet mode of operation.
Figure 1:
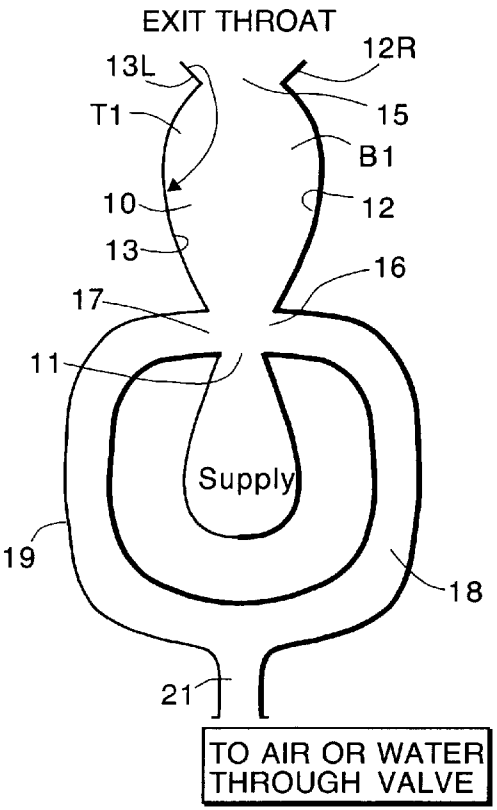
FIG. 1 is a schematic illustration of the geometry of one embodiment of the invention having a crossover-type interaction region for the fluidic oscillator.
Figure 4:
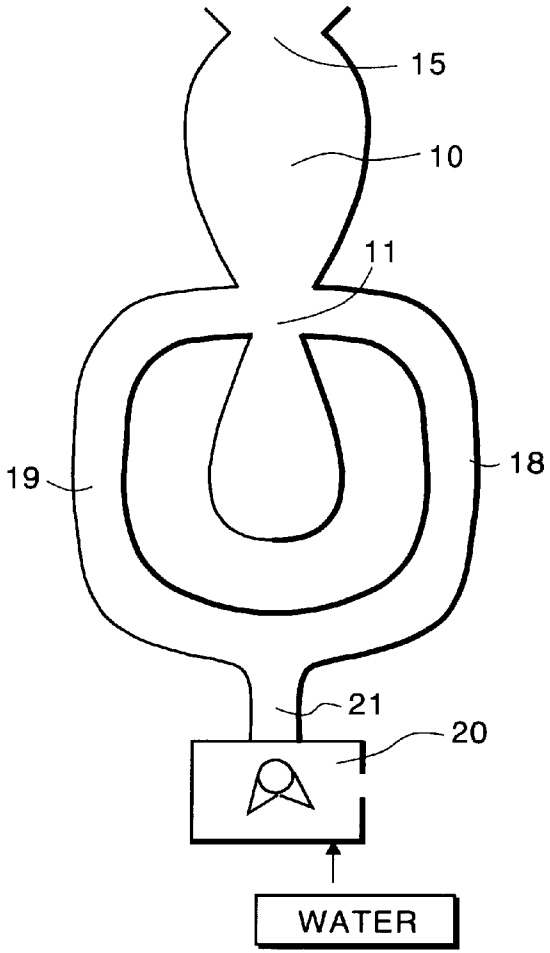
FIG. 4 illustrates the spa nozzle with dual operating modes and a mode selector valve.

Referring to FIGS. 1–4, in a first embodiment of the invention, a fluidic oscillator of the crossover-type interaction chamber 10 has an upstream end supplied with a jet of water by a power nozzle 11 connected to a supply (not shown). The jet of water is projected into the interaction region which has sidewalls 12 and 13 which first diverge and then converge to an outlet or exit throat 15. A pair of control ports 16 and 17 are provided immediately downstream of the power nozzle 11 and are interconnected by an inertance control loop sections 18 and 19 which are connected via connector passage 21 to a mode selector valve 20 (FIG. 4). The fluidic spa nozzle has top T1 and a bottom B1 wall which may diverge (topwall T1 is only partially shown). When the water is supplied to power nozzle 11, a jet of water is projected through the power nozzle to the outlet aperture or exit throat 15 and exit in a straight line as illustrated in FIG. 2. In FIG. 2, when the common connection 21 to inertance loop sections 18 and 19 is opened to air, there is no oscillation, and the jet of aerated water JWA projects through the exit aperture or throat 15 directly into the spa tub. It should be kept in mind that all of the operations described herein are submerged or below water level in the spa. The flow past the control ports 16 and 17 aspirates or entrains air for providing an air bubble filled (aerated) jet of water JWA. Note that air is entrained through both inertance loop sections 18 and 19 through control ports 16 and 17. When the mode selector valve 20 is closed to air, water is allowed to fill the inertance loop sections. This water fills the loop which forms an inertance loop and induces oscillation in the manner generally described in Stouffer et al Pat. No. RE 33,158 (incorporated herein by reference). That is to say that a working fluid, namely, water filling the interaction region and inertance loop formed by inertance loop sections 18 and 19 flows back and forth in the inertance loop. The dynamic compliance in the form of the interaction vortex region defined between the sidewalls of the chamber which generally converge towards the outlet opening, such that the working fluid in the jet forms a vortex which alternately flows in opposite directions, the vortex alternately aspirating fluid from and supplying fluid to the first and second control ports in opposite stages and thereby through the inertance loop in alternately opposite directions.

Figure 3:
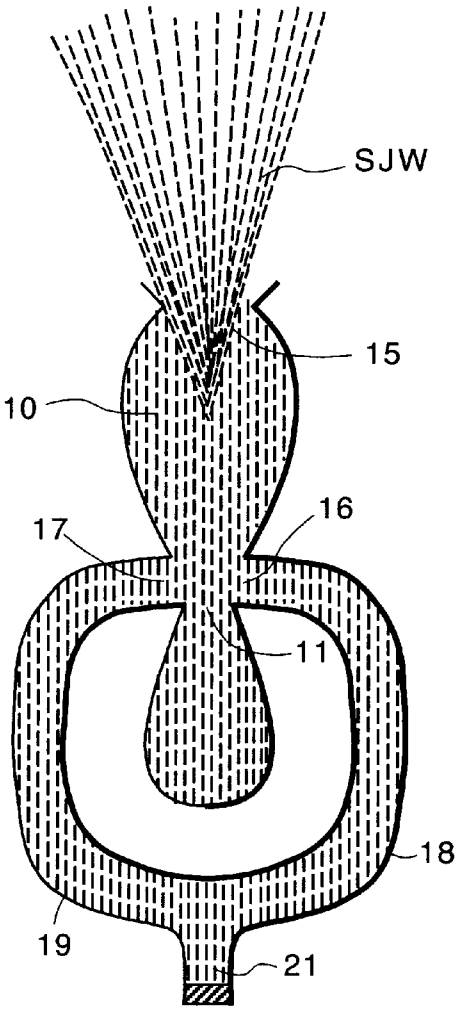
FIG. 3 shows the oscillating mode of the jet of water as it sweeps back and forth in the outlet for the interaction region.

The result is a sweeping jet of water SJW between the physical boundaries defined by the outlet exit throat 15 and outlet boundary walls 15L and 15R. The effect of the sweeping jet of water on the human body is a massaging effect which can be tuned by adjusting the length of the inertance loop constituted by inertance loop sections 18 and 19, or some fluidic circuit component (such as a variable fluidic capacitance) contained in inertance loop constituted by inertance loop sections 18 and 19. Also, as shown in FIG. 3, additional water may be allowed through passage 21 to change or modulate the frequency of oscillation.

Figure 6:
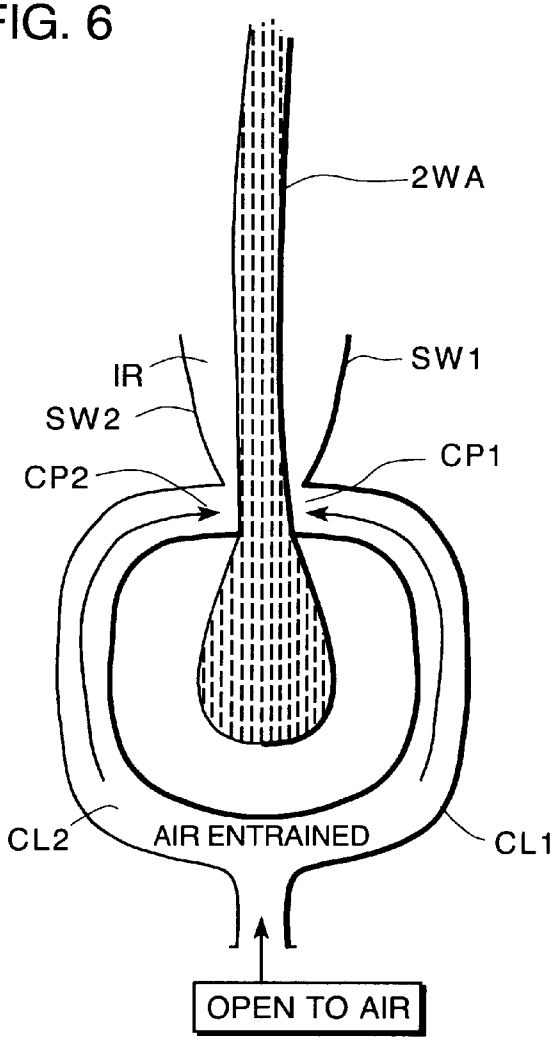
FIG. 6 is a diagrammatic illustration of the embodiment shown in FIG. 5 with air entrainment.
Figure 5:
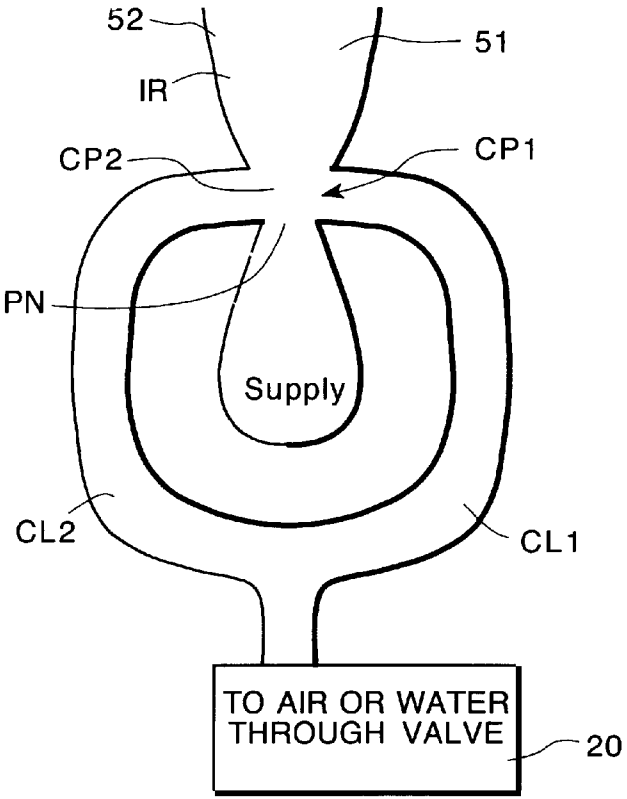
FIG. 5 is a plan view of another embodiment of the invention.
Figure 7:
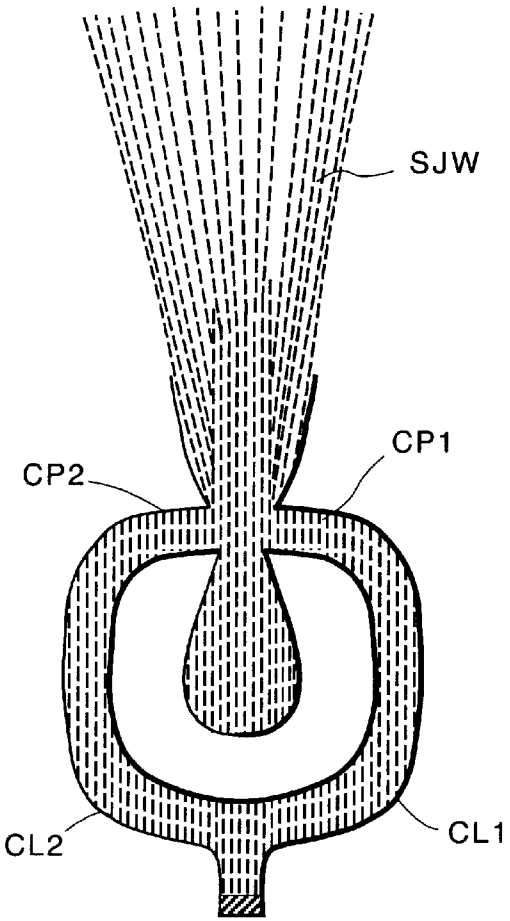
FIG. 7 is a diagrammatic illustration of the embodiment of FIG. 5 with the air entrainment closed off and water is allowed to flow back and forth in the inertance loop connecting the control ports.

Referring now to the embodiment shown in FIGS. 5, 6 and 7, the oscillator disclosed is of the non-crossover inertance loop type. In this type of fluidic oscillator, the interaction region IR has an upstream end and a downstream end. A power nozzle PN at the upstream end projects a jet of water into the interaction region IR. First and second control ports CP1 and CP2 at each side of the upstream end of the interaction region IR are at each side of the jet of water projected into the interaction region IR by the power nozzle PN. The control ports CP1 and CP2 are interconnected by an inertance loop CL having section CL1 and CL2. This inertance loop may be varied in length or include a variable fluidic circuit component such as a variable fluidic capacitance to vary the frequency of oscillation. The oscillation frequency may also be modulated by allowing water to be added to the inertance loop via control valve 20 V. The interaction region is defined by a pair of diverging wall attachment sidewalls SW1, SW2, floor and ceiling walls FW and CW (which may diverge in the downstream direction), with the upstream end of the diverging wall attachment sidewalls SW1 and SW2 being connected directly to the upstream wall forming control ports CP1 and CP2, respectively.

In operation, the water jet leaving the power nozzle PN interacts with the inertance loop CL to cause the jet of water to oscillate back and forth between the attachment sidewalls S1 and S2 at a frequency determined by the inertance loop sections CL1, CL2 and the oscillating frequency is also generally proportionate to the flow rate of water through the power nozzle PN. For a given device, the higher flow rate, the higher the frequency. When the inertance loop is connected to a source of air or open to air, there is no oscillation, and air is entrained or aspirated from ambient and control ports CP1, CP2 and the inertance loop sections C1, C2.

Figure 8A:
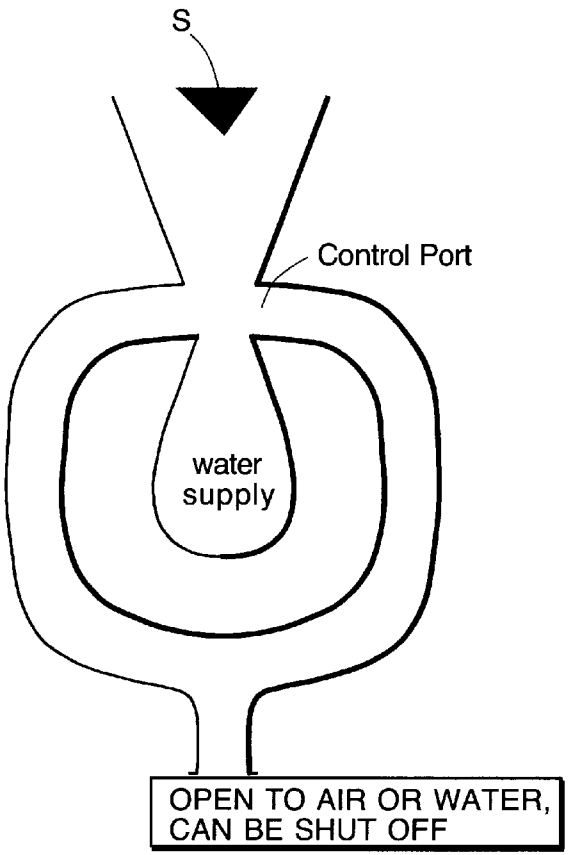
FIG. 8A is a plan view of a further embodiment of the invention showing the oscillator of FIG. 5 with a splitter.
Figure 8B:
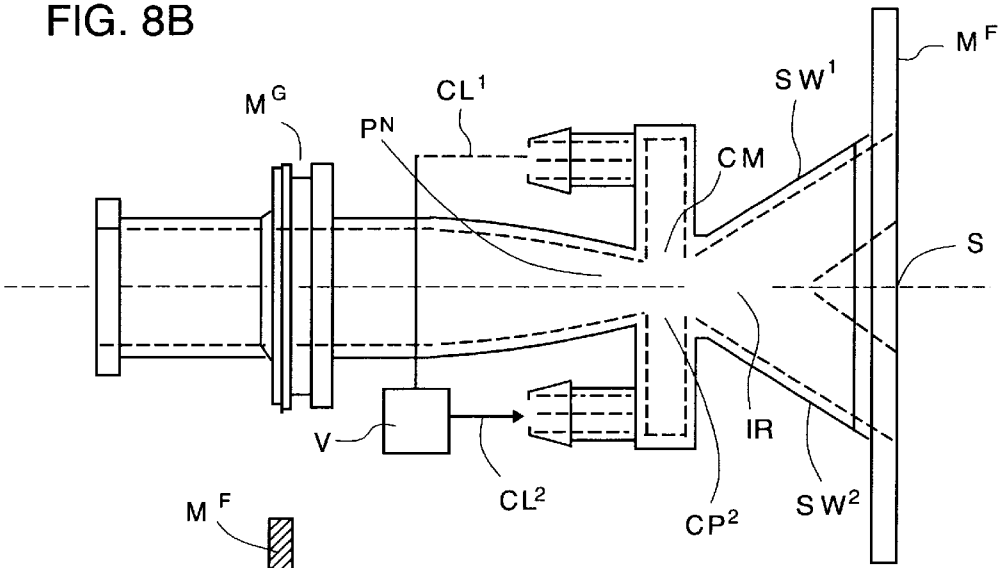
FIG. 8B is a top plan view thereon.
Figure 8C:
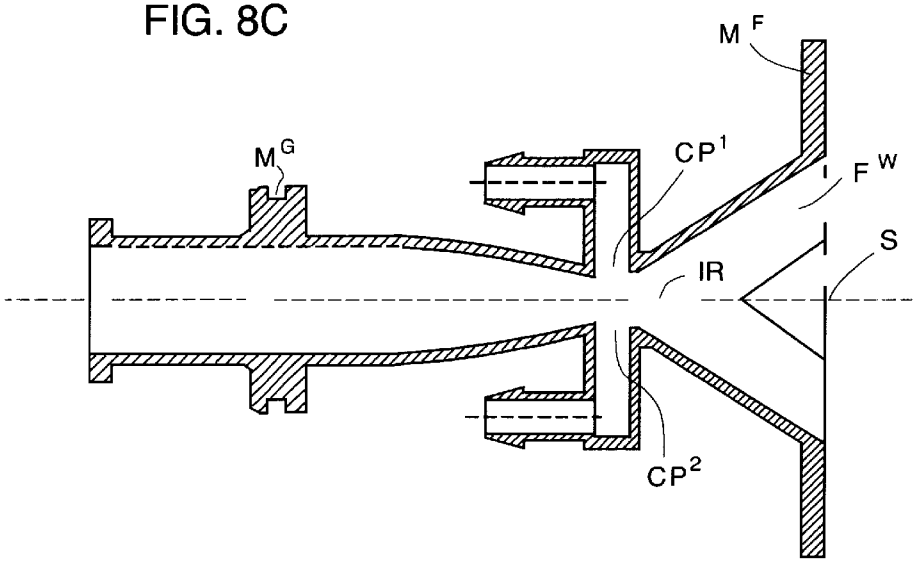
FIG. 8C is a sectional view.

In FIGS. 8B, 8C and 8C, the fluidic spa nozzle is provided with mounting gland MG and a mounting flange or plate MF for mounting in a spa wall. The connection to the control ports CP1 and CP2 by way of barbs B1 and B2 onto which are fitted hoses constituting the inertance loop sections CL1 and CL2 to control valve 20V which selects either air or the oscillating options.

Figure 9:
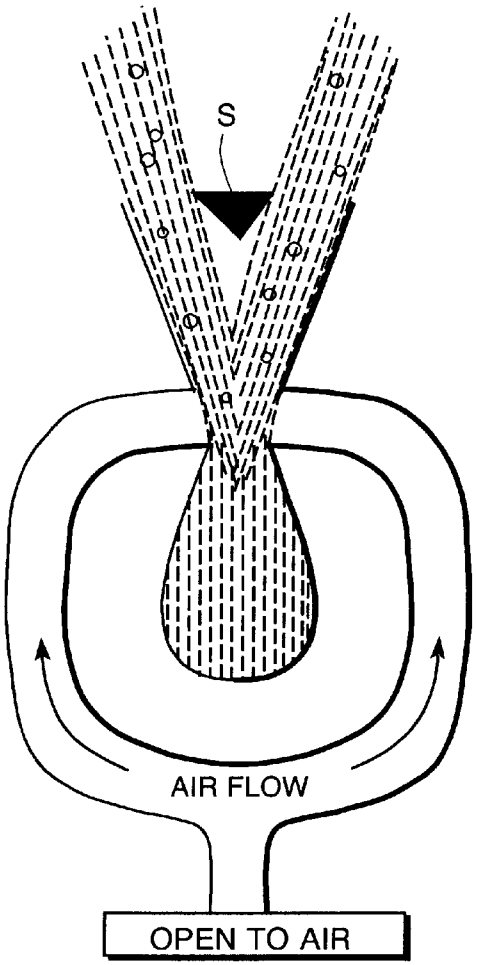
FIG. 9 is a diagrammatic illustration of the embodiment of FIG. 8 with air entrainment.
Figure 8D:
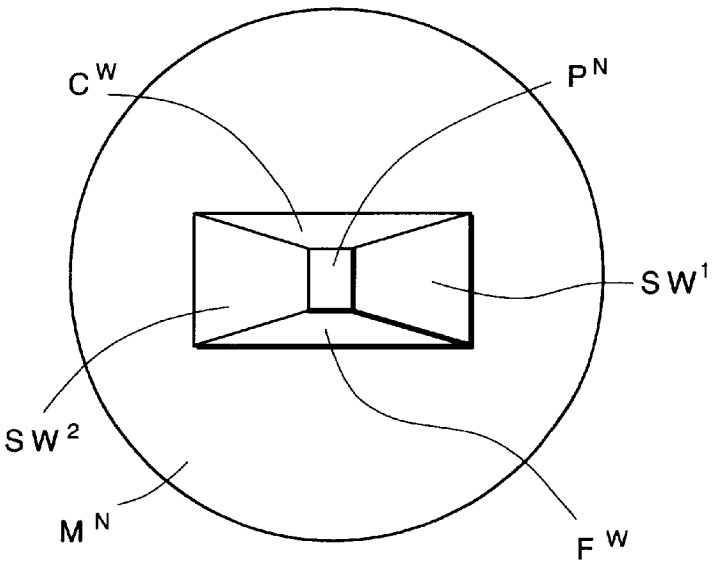
FIG. 8D is an end view with the splitter removed.
Figure 11:
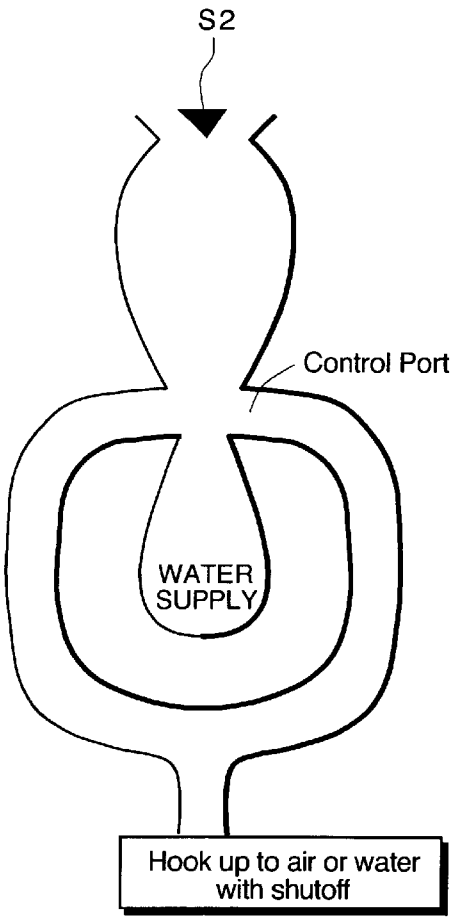
FIG. 11 is a plan view of a further embodiment of the invention showing a splitter in the outlet of the embodiment shown in FIG. 1.
Figure 10:
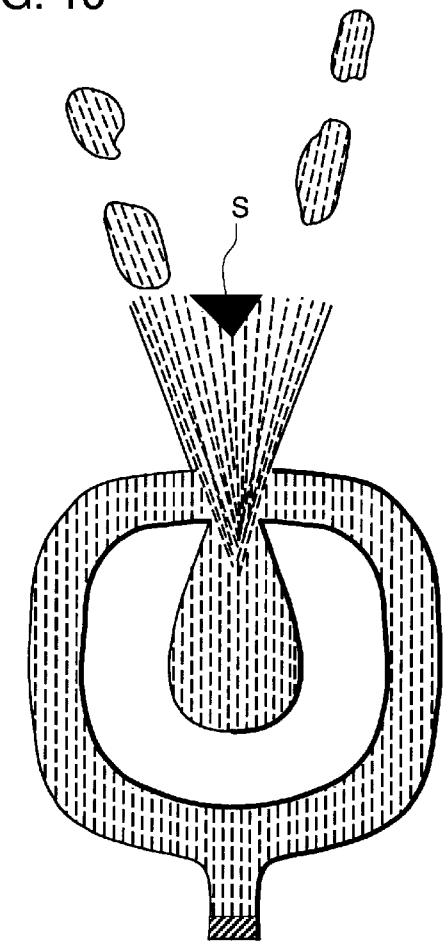
FIG. 10 is a diagrammatic illustration of the embodiment shown in FIG. 8 where a closed loop or inertance interconnects the control ports and shows the timed slugs of water issuing through the outlet.
Figure 13:
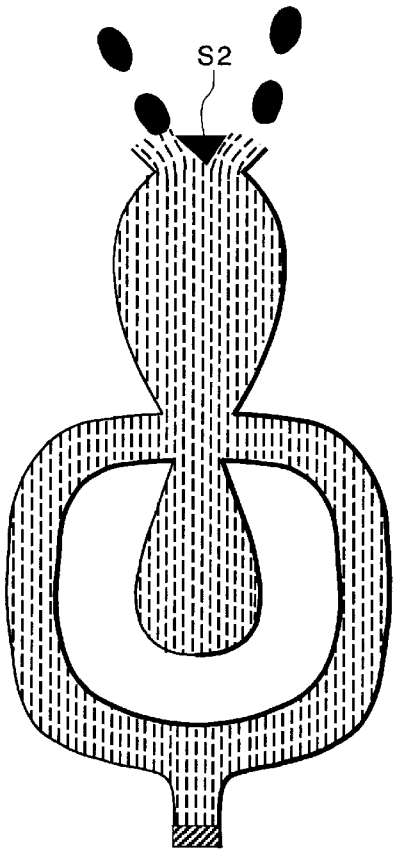
FIG. 13 is a diagrammatic illustration of the embodiment shown in FIG. 11 with the air inlet closed and the inertance loop interconnecting the control ports and showing slugs of water issuing through the outlet.
Figure 12:
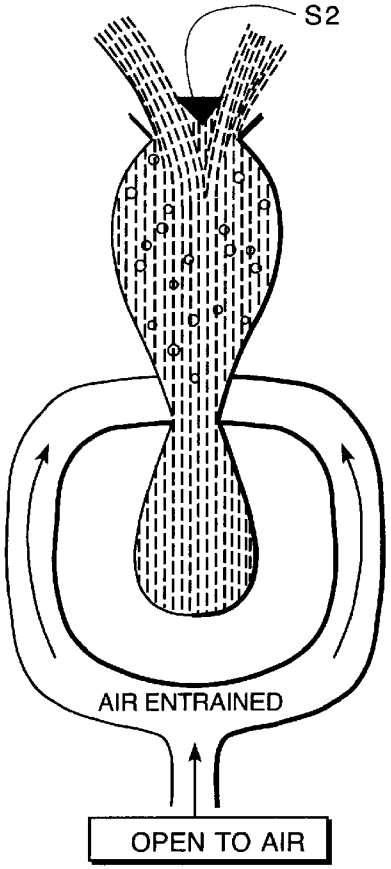
FIG. 12 is a diagrammatic illustration of the operation of the embodiment shown in FIG. 11 with air entrained.
Figure 14:
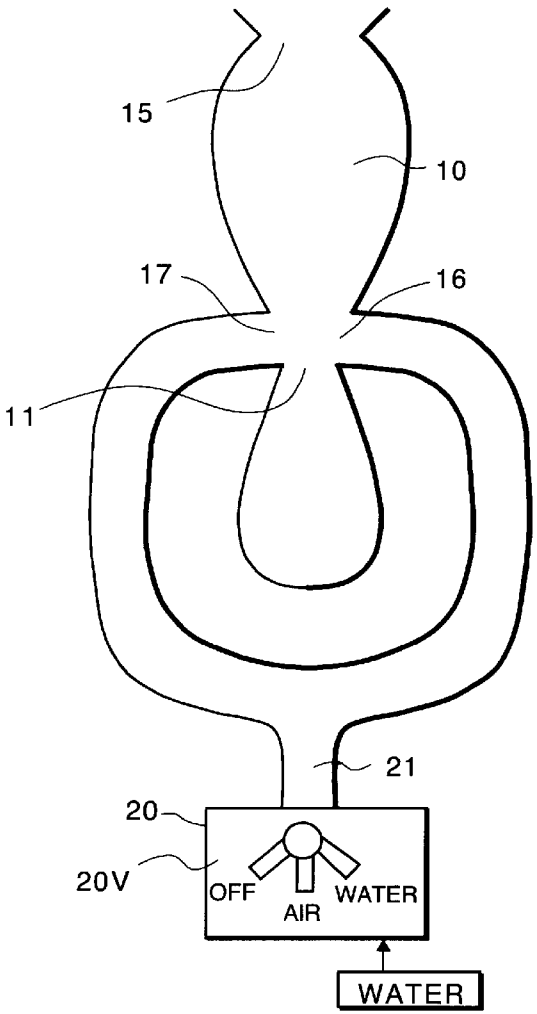
FIG. 14 is a diagrammatic illustration of the embodiment shown in FIG. 1 with a control valve for selecting the mode of operation.

The basic difference between the embodiment shown in FIGS. 5, 6 and 7 and the embodiment shown in FIGS. 8A, 9 and 10 is the addition of a splitter S. In the embodiment shown in FIGS. 8A, 9 and 10, the splitter S provides a pulsating water jet in which slugs of water are alternately issued to each side of the splitter S. Similarly, in the embodiment shown in FIGS. 11, 12 and 13, the difference between this embodiment and the embodiment shown in FIGS. 1–4 is the addition of a splitter S2 in the output. The splitter S2 divides the flow into two aerated flows in FIG. 12 which flows to each side of the splitter S2. In FIG. 13, the flow divides each side of the splitter and forms alternating slugs of non-aerated water. The slugs of water are projected through the body of water in the spa and impinge on the human body. Preferably, the slugs of water are timed, by tuning the inertance loop or modulating water added to the inertance loop, so as to approximate the recovery or restoration time of human flesh tissue.

Method and Apparatus for Maximizing Momentum Delivered by Water Jets for Underwater Massaging Applications This invention pertains to utilizing fluidic oscillators or pulse generators to maximize the momentum carried by water jets for underwater massaging applications. The above-described fluidic devices are characterized by having no moving parts and being of simple construction.

Commercial prior art designs for underwater massaging applications are typically of the rotating jet type as taught in U.S. Pat. Nos. 6,178,570, 5,920,925 and 5,657,496. These devices operate by utilizing the reaction force of the egressing jet to rotate the discharging orifice situated in a bearing. The resulting rotating jet moves along a circumferential path to produce massaging sensations by impacting on the user's body. One drawback with the above devices is obviously the moving parts subject to wear and tear and binding. Another functional disadvantage is that the length of time the jet spends in a given location is limited by the rate of rotation. The implication of the short amount of time spent by the jet in a given direction is that the volume of water or the momentum is also affected. The rate of rotation depends on the flow rate which means that a reduction in operating frequency is coupled to the flow rate or the intensity of the jet.

Techniques to slow down the rotational speed are discussed in U.S. Pat. Nos. 5,014,372 and 5,003,646, with gear wheels and brake washers and springs. The above means may serve the purpose of slowing down the rotation, but generally are very complex and expensive. Another technique to produce slow pulses is shown in U.S. Pat. No. 4,896,383. This device also has moving parts and also the jet travels through a considerable distance in the interior of the device before emerging into the spa tub, thereby losing a lot of momentum, before reaching the user.

The present invention solves the above problems by providing fluidic oscillators without moving parts, but having design flexibility. This allows for jets to be designed to operate at 2 to 6 Hz, even at full flow settings. The prior art designs would be operating at about 10 Hz at the full open position. A fluidic method to produce slow pulses is disclosed in U.S. Pat. No. 4,227,550. This device depends on continuous communication of the control passages to ambient air to produce the slow pulses, which will present design difficulties as well as practical difficulties with keeping the channels clear of obstructions. Also, the 4,227,550 device has only one mode of operation, which is to produce pulses mixed with air resulting in a reduction in the momentum produced by the jet. The present invention overcomes both the above issues by not requiring open channels and being able to produce pulses or slugs of water without air.

Comparative tests have been conducted showing that the rotating jet cannot be effectively felt after about four (4) inches from the exit, with the jets being set to the maximum angle. At comparable angles, the fluidic jet can be felt at about ten (10) inches. If the angle of the rotating jet is reduced to increase the feel, the massaging effect is lost because the output jet positions start to overlap and flows merge with each other. A typical valve for the flow rate is 12 GPM at 15 PSIG, at which pressure the fluidic was tested at 6 Hz compared to 10 Hz for the rotating jet. The fluidic jet oscillating at 7 Hz is very "heavy-ended" and the jet travel time is minimal.

Thus, it spends about, say roughly 0.07 seconds at each end. This compares to the rotating jet which spends roughly 0.0027 seconds in each position. This value is very generous in the sense that the travel time for jet thickness is taken to be the minimum meaningful unit of time. If we did not consider the jet thickness, the time spent in a given direction will be 0.00027 seconds. This means that the fluidic jet spends roughly 26 times the amount of time spent by the rotating jet in a given location. Thus, it is seen that at the same flow rate of 12 GPM, the fluidic will have:

$$\text{Fluidic flow per pulse} = \frac{12\text{ gallons}}{\text{min}} \times \frac{1\text{ min}}{60\text{ sec}} \times \frac{1\text{ sec}}{6\text{ cycles}} \times \frac{1\text{ cycle}}{2\text{ pulses}}$$

$$= 0.0166\text{ gallons/pulse}$$

This compares to the rotational jet which will have $$\begin{array}{c}\text{Jet flow per "pulse"}\\ \text{(flow in a given direction)}\end{array} = \frac{12\text{ gallons}}{\text{min}} \times \frac{1\text{ min}}{60\text{ sec}} \times \frac{0.0027\text{ sec}}{\text{"pulse"}}$$

$$= 0.00054\text{ gallons/pulse}$$

At the water density of 8.34 lb/gallon, the mass flow per pulse will be:

Fluidic mass flow = 0.14 lb/pulse

Jet mass flow = 0.0045 lb/pulse

Thus, the fluidic jet will deliver approximately 30 times the momentum delivered by the rotating jet.

When the flow rate is decreased by the user, the frequency of the fluidic also decreases, but very predictably because the frequency and flow rate have a linear relationship. In the rotating jet nozzle, because friction is involved, the decrease in frequency is not as consistent as the fluidic device.

An estimate of the force delivered by the fluidic and the rotating jet may be made as follows, based on subjective data. The initial velocity of both jets (rotating and the fluidic) operating at 15 PSI will be:

$$V_1 = 12 \times 15^{0.5} = 46.5\text{ f/sec.}$$

The rotating jet velocity reached zero at 4" while the fluidic jet velocity reaches zero at 10". The deceleration of the two jets is calculated as below:

$$V = U + at \tag{1}$$

where V=Final Velocity

U=Initial Velocity a=Acceleration t=Time To Reach Final Velocity

Final velocity in both cases is zero, $$O=46.5+at$$

or $$at=-46.5 \quad (2)$$

Also $$S=Ut+\tfrac{1}{2}at^2$$

Where

S=Distance Traveled $$S=46.5t+\tfrac{1}{2}at^2$$

Substitute $$t=\frac{-46.5}{a}\text{from (2)} \quad (3)$$

$$S=46.5\frac{(-46.5)}{a}+\frac{1}{2}(a)\frac{(-46.5)^2}{(a^2)}$$

$$=\frac{-46.5^2}{a}+\frac{46.5^2}{2a}$$

$$S=\frac{-46.5^2}{2a}$$

In the case of the rotating jet:

S=4" or 0.33 ft $$0.33=\frac{-46.5^2}{2a}$$

or $$a_j=\frac{-46.5^2}{2\times 0.33}=-3243\ \text{ft/Sec}^2$$

Deceleration for the fluidic jet will be:

$$0.833=\frac{-46.5^2}{2a}$$

or $$a_f=\frac{-46.5^2}{2\times 0.833}=-1297\ \text{ft/sec}^2$$

Force delivered by rotating jet per pulse:

$$Fj=0.0045\frac{\text{lbm}}{\text{Pulse}}\times 3243\frac{\text{ft}}{\text{sec}^2}\times\frac{\text{sec}^2}{32.2\ \text{ft}}$$

$$=-0.454\ \text{lb}_f$$

Negative sign indicates that the force is decreasing.
Force delivered by the fluidic jet per pulse:

$$Ff=0.14\frac{\text{lbm}}{\text{Pulse}}\times 1297\frac{\text{ft}}{Sa^2}\times\frac{\text{sec}^2}{32.2\ \text{ft}}$$

$$=-5.6\ \text{lb}_f$$

Thus the fluidic delivers roughly 12 times the force over 2.5 times longer distance.

While the invention has been described in relation to preferred embodiments of the invention, it will be appreciated that other embodiments, adaptations and modifications of the invention will be apparent to those skilled in the art.

What is claimed is:

1. A spa nozzle for submerged use in a spa and having dual operating modes, comprising:

a body having an interaction region with upstream and downstream ends, said interaction region having a pair of sidewalls which smoothly diverge from said upstream end, a power nozzle coupled to a source of water under pressure and adapted to issue a jet of water into said interaction region at said upstream end, an exit throat at said downstream end for issuing into a body of water in said spa (a) a non-oscillating jet of water or (b) an oscillating jet of water, a pair of control ports at said upstream end of said interaction region, one control port at each side of the upstream end of said jet of water, a control fluid passageway connected to each control port, respectively, and a selection valve for selectively simultaneously connecting said control fluid passageways to (a) entrain air or (b) form an inertance loop for the back and forth flow of water between said control ports and sustain oscillation of said jet of water.

2. The spa nozzle as defined in claim 1 wherein said diverging walls merge into converging side walls at said downstream end leading to said exit throat and defining a crossover region type of interaction region.

3. The spa nozzle as defined in claim 1 including a splitter means in said downstream end dividing said outlet into a pair of outlets.

4. The spa nozzle defined in claim 2 including a splitter in said outlet.

5. The spa nozzle defined in claim 1 wherein said selection valve can admit additional water to modulate the frequency of oscillation.

6. The spa nozzle defined in claim 1 wherein the underwater jet is in the form of slugs of water which can be timed to impinge on a human body in the spa at a rate which approximates the restoration rate of human tissue between the impingement of said slugs of water.

7. A fluidic spa nozzle for submerged use in a spa and having dual operating modes, said spa nozzle comprises a body having an interaction region with upstream and downstream ends, the interaction region having sidewalls which smoothly diverge from the upstream end, a power nozzle coupled to a source of water under pressure and adapted to issue a jet of water into the interaction region at the upstream end of said interaction region, a pair of control ports at the upstream end of the interaction region with one control port at each side of the upstream end of the power jet, respectively, a pair of control passageways connected each control port respectively and a selection valve which selectively simultaneously connects the control fluid passageways to:

(a) entrain ambient air or (b) form an inertance loop for the back and forth flow of water between the control ports and sustain oscillation of the jet of water, the exit at the downstream end issues a jet of water into a body of water in the spa in two modes:

(a) a non-oscillating jet of aerated water or (b) an oscillating jet of water.

8. The invention defined in claim 7 including a splitter to define the flow into two jets of aerated water or two jets or slugs of water issuing to each side of the divider into a water filled spa.

9. The invention defined in claim 7 wherein the underwater jet is divided into slugs of water which can be timed to impinge on a human body in the spa at a rate which approximates the restoration rate of human tissue between the impingement of said slugs of water.

10. A method for maximizing the momentum delivered by water jets for underwater spa massaging applications with no moving parts comprising:

providing a fluidic oscillator having an oscillation range of operation from about 12 Hz to about 1 Hz at full-flow settings, feeding only water to said fluidic oscillator to cause said fluidic oscillator to initiate oscillation and project a sweeping jet of water into said spa at sweep rate from about 12 Hz to about 1 Hz determined by the rate of flow of fluid through said fluidic oscillator.

11. A method for maximizing the momentum delivered by water jets for spa underwater massaging applications with no moving parts comprising:

providing a fluidic oscillator having an oscillation range of operation from about 12 Hz to about 1 Hz at full-flow settings, feeding only water to said fluidic oscillator to cause said fluidic oscillator to initiate oscillation and project an alternating pair of slugs of water into said spa to impinge on a human body immersed in said spa at a rate from about 12 Hz to about 1 Hz determined by the rate of flow of fluid through said fluidic oscillator.

12. A spa nozzle for maximizing the momentum delivered by water in underwater spa massaging applications comprising:

a no-moving-parts fluidic oscillator having an oscillation range of operation for oscillating a jet of water from about 12 Hz to about 1 Hz at full-flow settings, said fluidic oscillator projecting an alternating pair of slugs of water into said spa to impinge on a human body immersed in said spa at a rate from about 12 Hz to about 1 Hz determined by the rate of flow of fluid through said fluidic oscillator.

13. A spa nozzle for maximizing the momentum delivered by water in underwater spa massaging applications comprising:

a no-moving-parts fluidic oscillator having an oscillation range of operation for oscillating a jet of water from about 12 Hz to about 1 Hz at full-flow settings, said fluidic oscillator being heavy-ended and projecting an alternating jet of water into said spa to impinge on a human body immersed in said spa at a rate from about 12 Hz to about 1 Hz determined by the rate of flow of fluid through said fluidic oscillator.

* * * * *